US006715948B2

(12) United States Patent
Morita et al.

(10) Patent No.: US 6,715,948 B2
(45) Date of Patent: Apr. 6, 2004

(54) PRINTER

(75) Inventors: Seiji Morita, Sayama (JP); Makoto Kawasaki, Tokorozawa (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 09/986,361

(22) Filed: Nov. 8, 2001

(65) Prior Publication Data

US 2002/0056354 A1 May 16, 2002

(30) Foreign Application Priority Data

Nov. 10, 2000 (JP) ..... 2000-344312

(51) Int. Cl.[7] ..... B41J 11/70
(52) U.S. Cl. ..... 400/621; 400/693
(58) Field of Search ..... 400/621, 691, 400/693

(56) References Cited

U.S. PATENT DOCUMENTS 5,105,703 A * 4/1992 Kondo ..... 83/636
6,361,231 B1 * 3/2002 Sato et al. ..... 400/621
6,447,187 B1 * 9/2002 Robinson ..... 400/621

FOREIGN PATENT DOCUMENTS

JP 6-226684 8/1994
JP 2001146358 A * 5/2001 ..... B65H/35/08

* cited by examiner

*Primary Examiner*—Daniel J. Colilla
(74) *Attorney, Agent, or Firm*—Finnegan, Henderson, Farabow, Garrett & Dunner, L.L.P.

(57) ABSTRACT

There is provided a printer comprising: a fixed cutting edge; and a movable cutting edge that moves toward the fixed cutting edge over a predetermined cut moving range from a cut starting position to a cut ending position, thereby to cut paper in cooperation with the fixed cutting edge. In this printer, the fixed cutting edge can move between a fixed-cutting edge mount position at which it is possible to cut the paper in cooperation with the movable cutting edge and a fixed-cutting edge dismount position at which it is not possible to cut the paper in cooperation with the movable cutting edge. When the fixed cutting edge is at the fixed-cutting edge mount position, the movable cutting edge can move between a movable-cutting edge cut position, at which movement of the fixed cutting edge toward the fixed-cutting edge dismount position is not permitted, and a movable-cutting edge non-cut position, at which movement of the fixed cutting edge toward the fixed-cutting edge dismount position is permitted.

11 Claims, 7 Drawing Sheets

PRINTER

BACKGROUND OF THE INVENTION

1. Field of the Invention

The present invention relates to a printer for carrying out printing on paper, and for conveying and cutting the paper into sheets.

2. Description of the Related Art

Conventionally, a cutter that has a fixed cutting edge and a movable cutting edge has been used for cutting paper in a printer that carries out printing on the paper with a print head. In this case, the fixed cutting edge is disposed at one side and the movable cutting edge is disposed at the other side, with the paper-conveying route being sandwiched between the two cutting edges. To cut the paper, the movable cutting edge is moved toward the fixed cutting edge. In order to cut the paper accurately, it has been necessary to position the fixed cutting edge and the movable cutting edge very precisely.

However, according to what is called a clamshell type printer wherein the conveying route of the paper can be opened, the employment of the cutter using the fixed cutting edge and the movable cutting edge has had various kinds of problems. For example, there have been difficulties in disposing the fixed cutting edge and the movable cutting edge, precision in the positioning of the fixed cutting edge and the movable cutting edge, a cutting procedure, costs, etc.

SUMMARY OF THE INVENTION

In accordance with an aspect of the present invention, there is provided a printer comprising: a fixed cutting edge; and a movable cutting edge that moves toward the fixed cutting edge over a predetermined cut moving range from a cut starting position to a cut ending position, thereby to cut paper in cooperation with the fixed cutting edge. In this printer, the fixed cutting edge can move between a fixed-cutting edge mount position at which it is possible to cut the paper in cooperation with the movable cutting edge and a fixed-cutting edge dismount position at which it is not possible to cut the paper in cooperation with the movable cutting edge. Further, when the fixed cutting edge is at the fixed-cutting edge mount position, the movable cutting edge can move between a movable-cutting edge cut position at which movement of the fixed cutting edge toward the fixed-cutting edge dismount position is not permitted and a movable-cutting edge non-cut position at which movement of the fixed cutting edge toward the fixed-cutting edge dismount position is permitted.

BRIEF DESCRIPTION OF THE DRAWINGS

The features of the present invention will be more apparent from the following description of preferred embodiments with reference to the accompanying drawings.

DETAILED DESCRIPTION

A printer relating to the present invention will be explained below.

Figure 1:
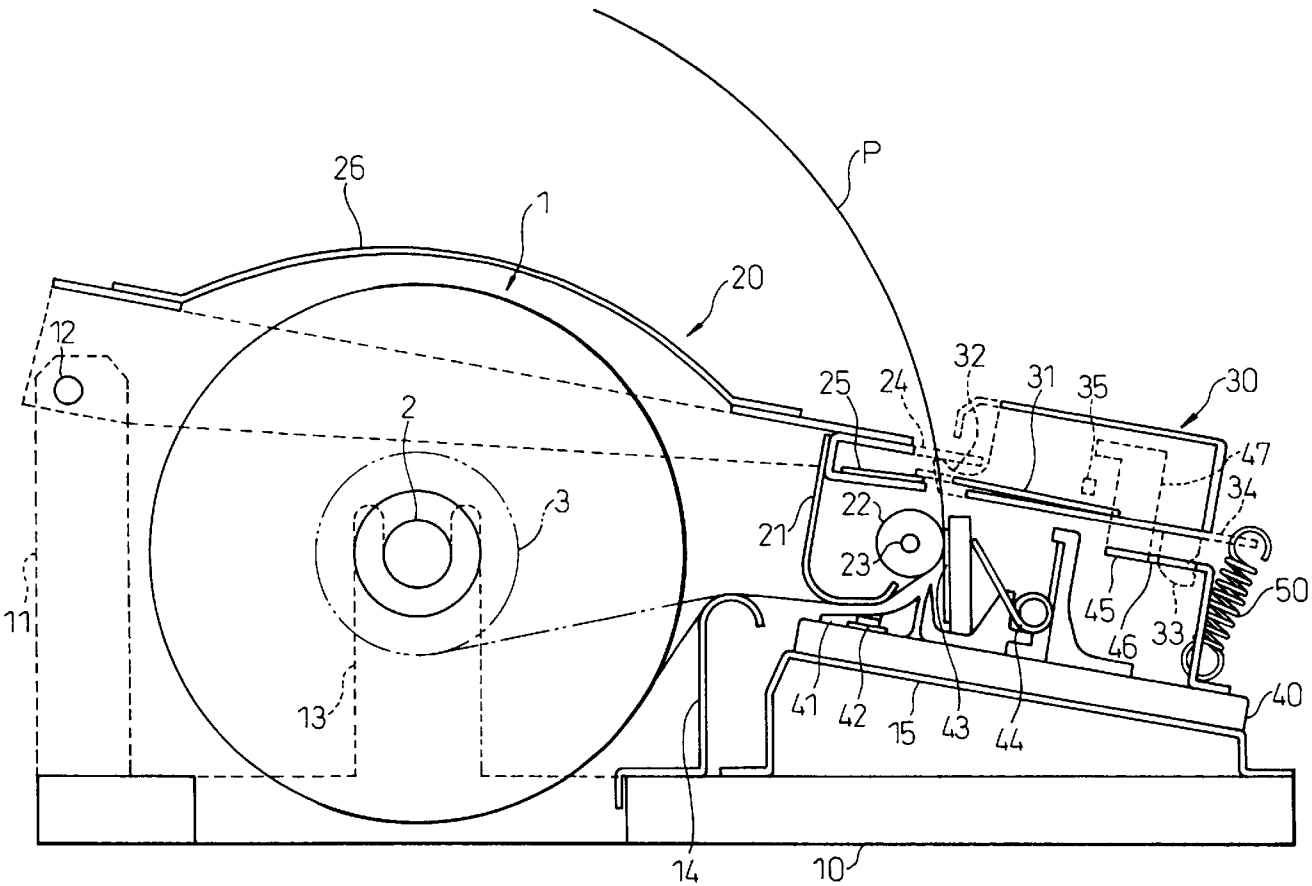
FIG. 1 is a schematic center cross-sectional view of a printer relating to the present invention, where a cover frame is at a mount position.

FIG. 1 is a schematic center cross-sectional view of the printer relating to the present invention. Reference number 1 denotes a roll of thermal paper, 2 denotes an axis of the roll of thermal paper 1, and 3 expressed in a two-dot chain denotes a status in which the diameter of the roll has become small as a result of use of thermal paper P. Reference number 10 denotes a base, 20 denotes a platen cover, and 30 denotes a cutter unit.

The base 10 is provided with a first holding member 11, a bearing member 13, a guide member 14, and a plate holding member 15. The first holding member rotatably holds a cover frame 20 around the axis 12. The bearing member 13 rotatably holds the axis 2 of the roll of thermal paper 1.

The guide member 14 has a function of conveying the thermal paper P fed out from the roll of thermal paper 1, always substantially at a constant height, to a direction of a line thermal head 43 to be described later. When the diameter of the roll of thermal paper 1 has become small, the position from which the thermal paper P comes out is changed. Therefore, the guide member 14 has the function of conveying the thermal paper P to the direction of the line thermal head 43 always at the same height by turning the direction of conveyance of the thermal paper P. Accordingly, it is preferable that the guide member 14 have a height at least that of the lowest point of the center axis 2 of the roll of thermal paper 1.

The cover frame 20 has a restricting member 21, a platen roller 22, a platen roller axis 23, a first engaging member 24, a fixed cutting edge 25, and a dome-shaped plate member 26.

The cutter unit 30 has a movable cutting edge 31, a second engaging member 32, a swing supporting member 33, a projection 34, and a stopper 35.

The plate 40 is fixed on the plate holding member 15. On the plate 40, there are provided a guide plate 41, a sensor 42, the line thermal header 43, an elastic member 44, and a second holding member 45. The second holding member 45 is provided with a groove 46, and a third engaging member 47. The swing supporting member 33 of the cutter unit 30 is inserted into the groove 46 provided on the second holding member 45. The cutter unit 30 as a whole is held on the holding member 45 so as to be able to swing up and down around the swing supporting member 33 as a supporting point.

The sensor 42 is fitted to a lower side of the guide plate 41 in order to detect the presence or absence of the thermal paper P. A reflection type sensor comprising a light-emitting element and a light-receiving element is used as the sensor 42. When the thermal paper P is not detected at the position of the sensor 42, the sensor transmits a signal that indicates the absence of paper to a control circuit, not shown. In the reflection type sensor, the light-emitting element emits light to the conveying route, and the light-receiving element receives the light reflected from the paper, thereby to detect the presence or absence of the paper. Accordingly, it is particularly preferable that the distance between the sensor and the paper be substantially constant in the reflection type sensor. Although the reflection type sensor is used in the present embodiment, it is also possible to use other types of sensors.

Reference number 50 denotes an elastic member (a spiral spring) provided between the projection 34 of the cutter unit 30 and the second holding member 45. The elastic member 50 constantly applies force to the cutter unit 30 so as to rotate it in a clockwise direction in FIG. 1.

Figure 2:
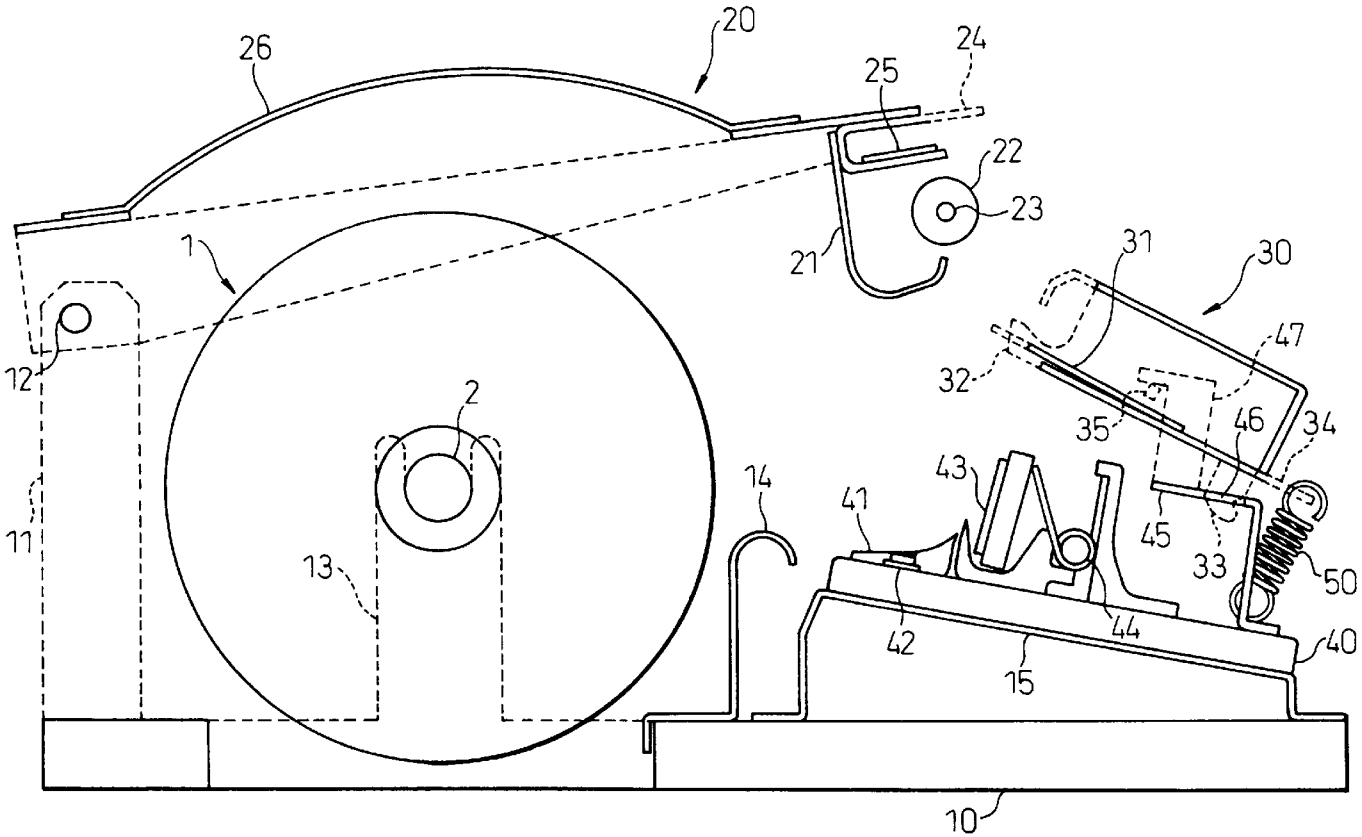
FIG. 2 is a schematic center cross-sectional view of the printer relating to the present invention, where the cover frame is at a dismount position.

The base 10 and the plate 40 and various kinds of members provided on the base 10 and the plate 40 will hereinafter be collectively called a main frame. In FIG. 1, the platen roller axis 23 is held on the main frame with a lock member 60 (not shown), and the cover frame 20 is maintained in the state as shown in FIG. 1. In this state, the cover frame 20 is at what is called a mount position (cover mount position). When holding of the platen roller axis 23 is in a released state, i.e. in a state as shown in FIG. 2, the cover frame 20 is at what is called a dismount position (cover dismount position).

When the cover frame 20 is held in the state as shown in FIG. 1, the first engaging member 24 of the cover frame 20 is engaged with the second engaging member 32 of the cutter unit 30 so as to press the cutter unit 30 in the counterclockwise direction. As a result, the cutter unit 30 is held at the position shown in FIG. 1 while acting against the force of the elastic member 50. Further, in this case, projections 31*a* and 31*b* at both sides of the movable cutting edge 31 of the cutter unit 30 press the fixed cutting edge 25 of the cover frame 20 from the top downward in FIG. 1. As a result, the projections 31*a* and 31*b* at both sides of the movable cutting edge 31 are positioned on the upper side of the fixed cutting edge 25 by being brought into contact with this portion. In the state shown in FIG. 1, a driving mechanism, not shown, moves the movable cutting edge 31 by sliding it on the fixed cutting edge 25 at the cover frame 20 side. In this way, it is possible to cut the thermal paper P.

The elastic member 44 applies force to the line thermal head 43 toward the platen roller 23, thereby sandwiching the thermal paper P between the platen roller 23 and the line thermal head 43. When the platen roller 23 rotates in the state shown in FIG. 1, the thermal paper P is fed out from the roll of the thermal paper 1, and conveyed upward in FIG. 1.

The line thermal head 43 is provided with a plurality of heating elements in a line along a longitudinal direction of the platen roller 23. A driving circuit, not shown, heats the heating elements, thereby to print on the thermal paper P. Accordingly, along the rotation of the platen roller 22, the printing is carried out on the thermal paper P while it is being conveyed, and the printed thermal paper P is discharged to outside of the printer. While the platen is formed in a roller shape in the present embodiment, the shape is not limited to the roller shape, and it is also possible to use other shapes, so long as the positional relationship between the printing head and the paper can be restricted. When the roller-shaped platen is not used, it is necessary to provide a separate conveying mechanism for conveying the paper.

FIG. 2 shows a case where the cover frame 20 is at the dismount position (cover dismount position). FIG. 2 shows a state in which holding of the platen roller axis 23 has been released. In the state shown in FIG. 2, the first engaging member 24 of the cover frame 20 is not pressing the cutter unit 30 in engagement with the second engaging member 32 of the cutter unit 30. Therefore, the elastic member 50 is applying force to the cutter unit 30 to rotate the cutter unit 30 in the clockwise direction in FIG. 2, with the swing supporting member 33 as a supporting point. However, as the stopper 35 of the cutter unit 30 is engaged with the third engaging member 47 provided on the frame 40, the cutter unit 30 is prevented from rotating in the clockwise direction beyond the position shown in FIG. 2. In FIG. 2, the lock member 60, not shown, holds the line thermal head 43 at a position away from the platen roller 23 against the force of the elastic member 44.

Figure 3:
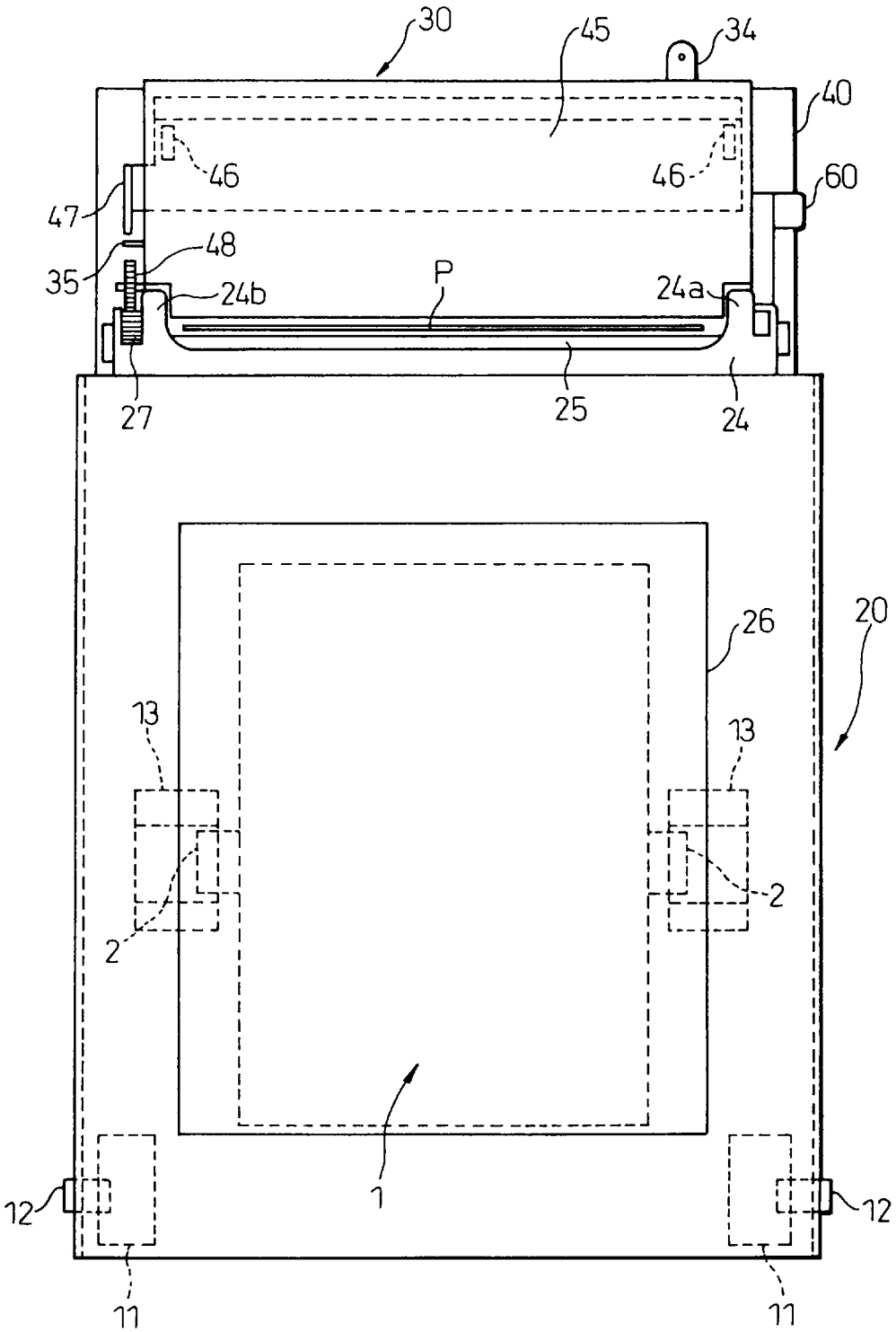
FIG. 3 is a schematic top plan view of a printer relating to the present invention, where a cover frame is at the mount position.

FIG. 3 is a top plan view showing the state of FIG. 1 as observed from above. In FIG. 3, reference numbers 24*a* and 24*b* denote projections of the first engaging member 24 provided on the cover frame 20. Reference number 27 denotes a gear provided on the platen roller axis 23, and 48 denotes a gear provided on the plate 40. The gear 48 receives driving force from a motor not shown, and rotates the platen roller axis 23 in engagement with the gear 27. Reference number 60 denotes the lock member for holding the cover frame 20 in the position shown in FIG. 1. It can be understood from FIG. 3 that the thermal paper P passes between the cover frame 20 and the cutter unit 30, and between the projections 24*a* and 24*b* of the first engaging member 24.

Figure 4:
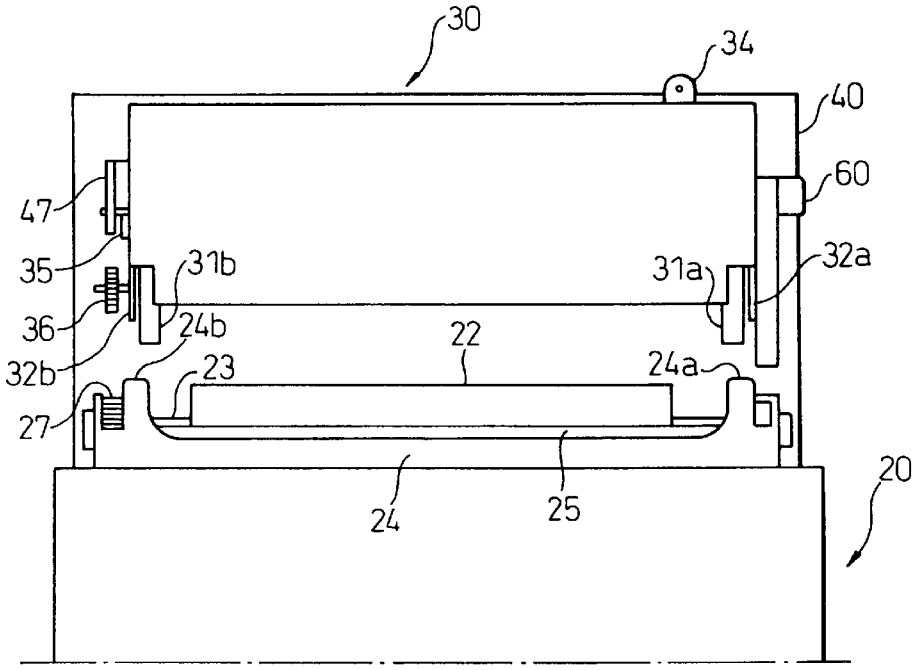
FIG. 4 is a schematic top plan view of a printer relating to the present invention, where a cover frame is at the dismount position.

FIG. 4 is a top plan view showing the state of FIG. 2 as observed from above. In FIG. 4, reference numbers 31*a* and 31*b* denote the projections of the movable cutting edge 31. Reference numbers 32*a* and 32*b* denote front end portions of both ends of the second engaging member 32. FIG. 4 show a state in which the stopper 35 of the cutter unit 30 is engaged with the third engaging member 47 provided on the plate 40.

Figure 5:
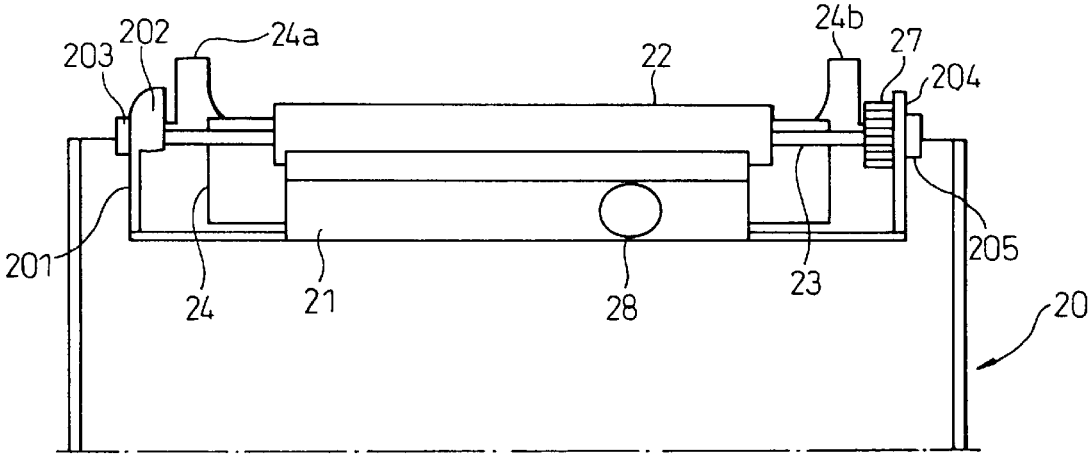
FIG. 5 is a view showing a front end portion of a cover frame of a printer relating to the present invention.

FIG. 5 is a view showing the front end portion of the cover frame 20. Reference number 28 denotes an opening provided on the restricting member 21. The opening is provided corresponding to a position where the sensor 42 is provided. Reference numbers 203 and 205 denote bearings for rotatably supporting the platen roller axis 23. Reference numbers 201 and 204 denote a pair of plate frames provided with the bearings 203 and 205. Reference number 202 denotes a pressing unit provided on the plate frame 201.

The restricting member 21 is disposed upstream of the platen roller 22 in the direction of conveyance of the thermal paper P, and has a width such that it can restrict the thermal paper P substantially over its respective entire width. The restricting member 21 maintains the distance between the thermal paper P and the sensor 42 substantially at a constant level, thereby preventing an error in the detection operation of the sensor 42. The restricting member 21 also has a substantially flat portion which is disposed so as to face the sensor 42. The opening 28 is provided substantially above the sensor 42, in a state in which the cover frame 20 is at the mount position as shown in FIG. 1. The opening 28 prevents the sensor 42 from making an erroneous recognition that the thermal paper P is present despite the absence of the thermal paper P, due to reflection of the light from the light-emitting element of the sensor 42 to the restricting plate 21. Although the restricting member is provided substantially over the entire width of the thermal paper P in the present embodiment, this is not always necessary if it is possible to maintain the distance between the thermal paper P and the sensor 42 substantially at a constant level near the sensor 42.

As explained above, the thermal paper P is fed out from the roll of thermal paper, and the conveying direction is curved slightly by the guide member 14. Then, the thermal paper P is conveyed keeping contact with the substantially flat portion of the lower end of the restricting member 21 of the cover frame 20. The thermal paper P is discharged in the upper direction in FIG. 1 in a state of being sandwiched between the platen roller 22 and the line thermal head 43.

Figure 6:
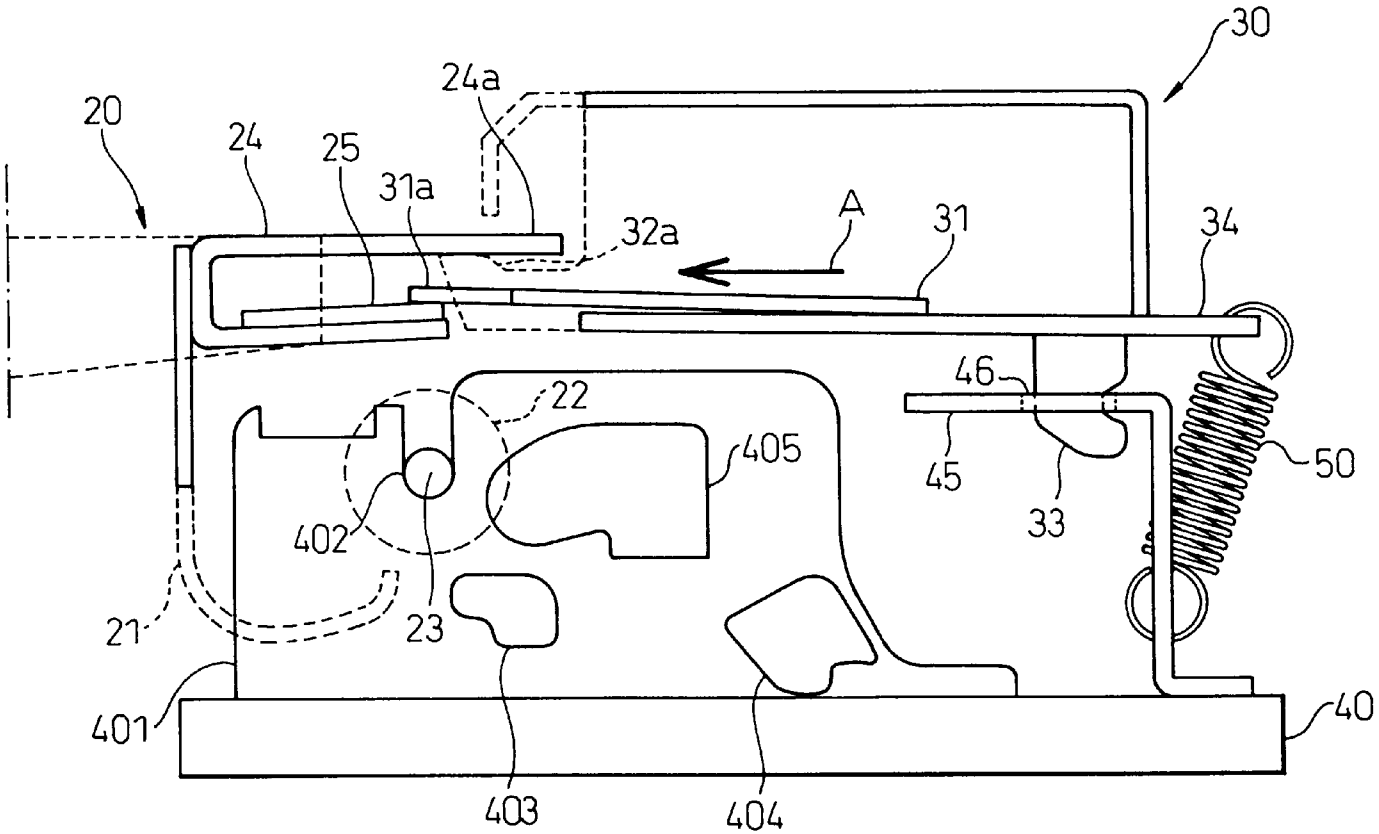
FIG. 6 is a view showing a positional relationship between a fixed cutting edge and a movable cutting edge when a cover frame is at the mount position in the printer according to the present invention.

The cutting of the thermal paper P will be explained in detail below. FIG. 6 shows the state of the fixed cutting edge 25 and the movable cutting edge 31 in detail when the cover frame 20 is at the mount position (cover mount position) shown in FIG. 1.

In FIG. 6, the platen roller axis 23 provided on the cover frame 20 is held in a U-shape groove 402 of a side wall 401 provided on the frame 40. The platen roller axis 23 is held in the U-shape groove 402 by the lock member 60, not shown. The side wall 401 is provided with a projection 403, a projection 404, and a cam hole 405. The projection 403, the projection 404, and the cam hole 405 hold the platen roller axis 23 and press the line thermal head 43 to the platen roller 22 in cooperation with the lock member 60 and the elastic member 44.

When the movable cutting edge 31 slides in the direction of an arrow A with the driving mechanism, not shown, in the state shown in FIG. 6, the thermal paper P sandwiched between the fixed cutting edge 25 and the movable cutting edge 31 is cut by these cutting edges. As the projections 31*a* and 31*b* at both sides of the movable cutting edge 31 press the fixed cutting edge 25 from the top downward in advance in FIG. 6, the positional relationship between the fixed cutting edge 25 and the movable cutting edge 31 is maintained accurately even when the movable cutting edge 31 moves in the arrow A direction. Consequently, it is possible to cut the thermal paper P precisely and surely. The thermal paper P is conveyed from the bottom upward between the fixed cutting edge 25 and the projections 31*a* and 31*b* of the movable cutting edge 31.

In the state shown in FIG. 6, the cutter unit 30 is at a cut position (unit cut position), and similarly, the movable cutting edge 31 is at a cut starting position. When the movable cutting edge 31 has moved in the arrow A direction in the state shown in FIG. 6, and has completed the cutting of the thermal paper P, the movable cutting edge 31 is at a cut ending position. Further, when the cutter unit 30 has been swung around the swing supporting member 33 as a supporting point, and the state has changed to that shown in FIG. 7 as described later, the cutter unit 30 is at a non-cut position (unit non-cut position).

In the state shown in FIG. 6, the thermal paper P is printed by the line thermal head 43 while the thermal paper P is being conveyed from the bottom upward with the platen roller 22 in FIG. 6. Therefore, it is preferable that the movable cutting edge 31 be able to slide on the fixed cutting edge 25. In other words, when the movable cutting edge 31 slides in the arrow A direction, the thermal paper P is cut while moving slightly in the arrow A direction. In this case, the front end of the cut thermal paper P remains on the side surface of the fixed cutting edge 25, and no longer moves in the arrow A direction. However, if the positional relationship between the fixed cutting edge 25 and the movable cutting edge 31 were opposite to that shown in FIG. 6, the front end of the thermal paper P would move in the arrow A direction along the movement of the movable cutting edge 31 in the arrow A direction. In this case, there would be a risk of the thermal paper P jamming when the thermal paper P is conveyed next time by the platen roller 22. Accordingly, it is preferable that the fixed cutting edge be disposed at the upstream, and that the movable cutting edge be disposed at the downstream of the conveying direction of the thermal paper P, respectively.

Figure 8:
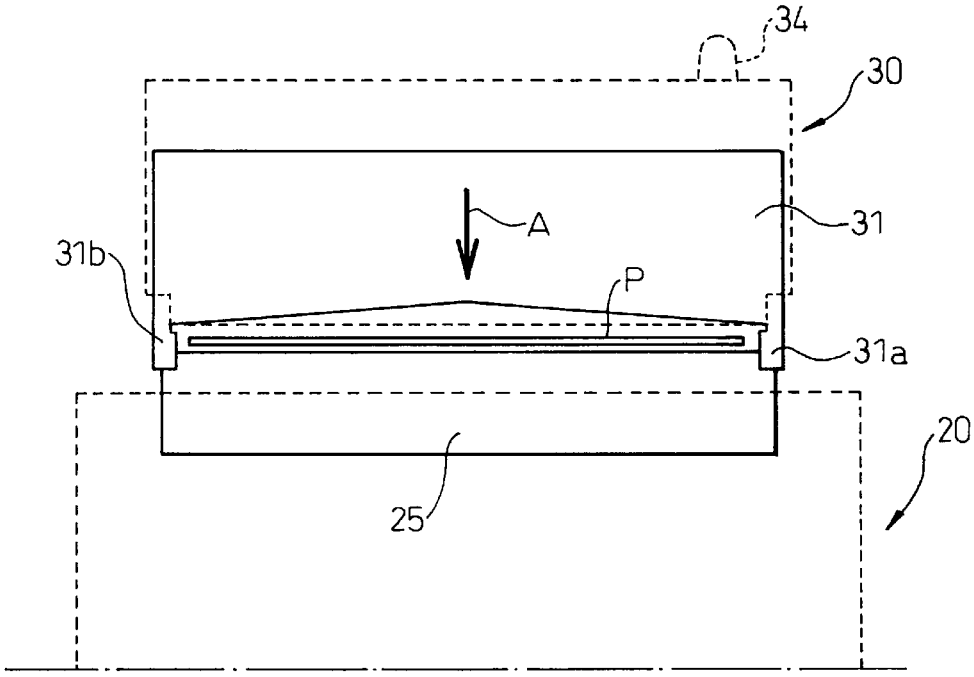
FIG. 8 is a view showing shapes of a fixed cutting edge and a movable cutting edge.

FIG. 8 shows a relationship between the fixed cutting edge 25, the movable cutting edge 31, and the thermal paper P in the state shown in FIG. 6. As shown in FIG. 8, the front end of the fixed cutting edge 25 is formed in a linear shape, and the front end of the movable cutting edge 31 is formed in a V-shape, with the center recessed from both ends 31*a* and 31*b*. Based on these shapes, it is possible to cut the thermal paper P smoothly. The shapes of the fixed cutting edge 25 and the movable cutting edge 31 are not limited to those shown in FIG. 8, and it is possible to suitably employ optional shapes.

Figure 7:
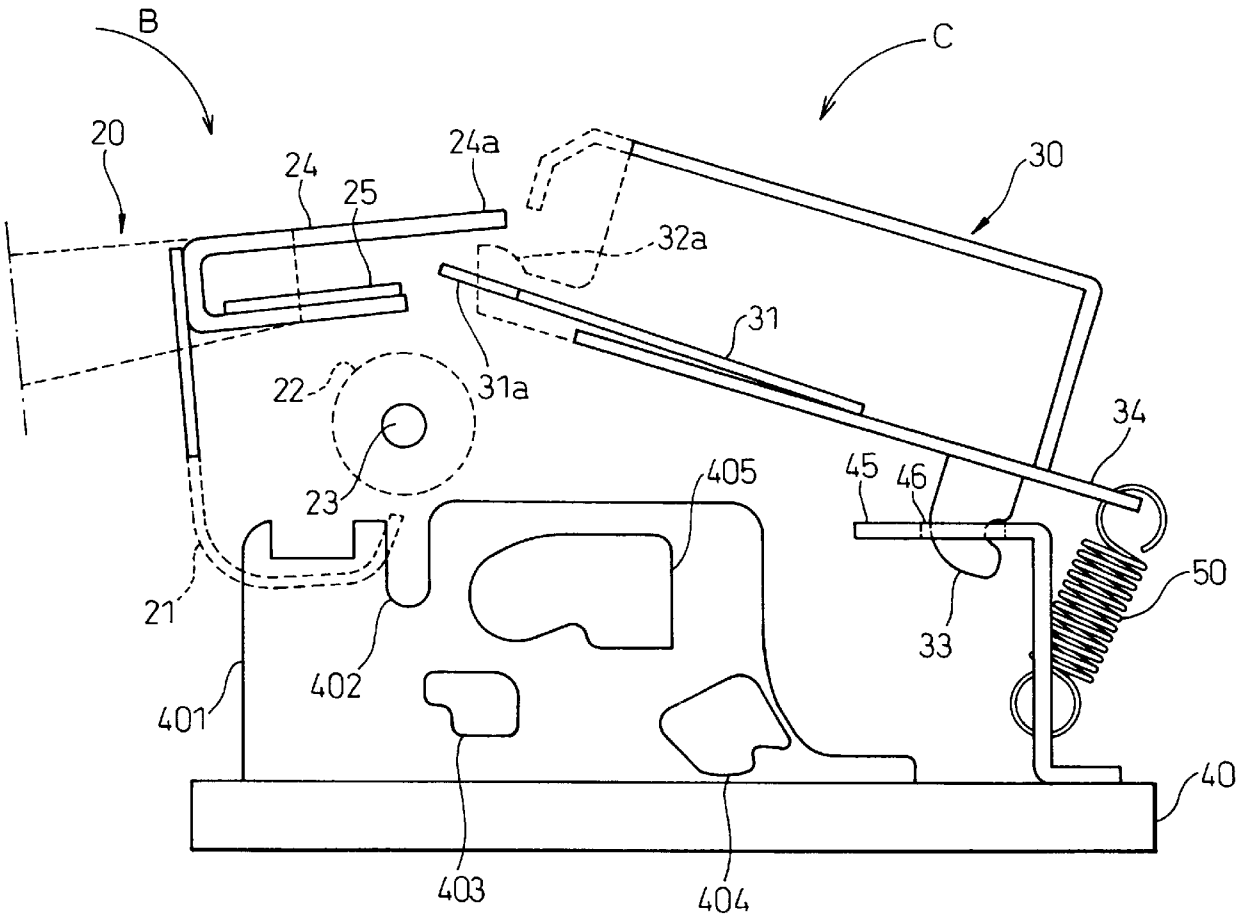
FIG. 7 is a view showing a positional relationship between a fixed cutting edge and a movable cutting edge when a cover frame is at a dismount position in a printer according to the present invention.

FIG. 7 shows a state in which the cover frame 20 shifts from the dismount position (cover dismount position) to the mount position (cover mount position). In the state shown in FIG. 7, the fixed cutting edge 25 is at the fixed-cutting edge dismount position, and the movable cutting edge 31 is at the movable-cutting edge non-cut position. When the cover frame 20 rotates in an arrow B direction in the state shown in FIG. 7, the projections 24*a* and 24*b* of the first engaging member 24 are engaged with the front ends 32*a* and 32*b* of the second engaging member 32 of the cutter unit 30. Then, the cutter unit 30 is rotated in an arrow C direction around the swing supporting member 33 as a supporting point. Consequently, the front end projections 31*a* and 31*b* of the movable cutting edge 31 of the cutter unit 30 are brought into contact with the fixed cutting edge 25 so as to be pressed upward from the bottom. As a result, the movable cutting edge 31 is positioned accurately on the fixed cutting edge 25. In this case, the fixed cutting edge 25 is at the fixed-cutting edge mount position at which it is possible to cut the thermal paper P in cooperation with the movable cutting edge 31, and the movable cutting edge 31 is at the movable-cutting edge cut position. When the movable cutting edge 31 is at the movable-cutting edge cut position, movement of the fixed cutting edge 25 toward the fixed-cutting edge dismount position is not permitted.

In the present embodiment, an example of the case of using thermal paper P as printing paper has been explained. However, it is also possible to use paper other than the thermal paper P. For example, it is possible to use ordinary paper, and also to use an inkjet head or the like instead of the line thermal head.

As explained above, according to the present invention, it is possible to carry out the positioning of the fixed cutting edge and the movable cutting edge with certainty, in the printer having the fixed cutting edge and the movable cutting edge disposed at saved positions.

Further, according to the present invention, it is possible to convey the paper properly without jamming, at the time of conveying the paper after it has been cut by the fixed cutting edge and the movable cutting edge.

Summarizing the advantageous effects of the invention, there is provided a printer comprising: a fixed cutting edge; and a movable cutting edge that moves toward the fixed cutting edge over a predetermined cut moving range from a cut starting position to a cut ending position, thereby to cut paper in cooperation with the fixed cutting edge. In this printer, the fixed cutting edge can move between a fixed-cutting edge mount position, at which it is possible to cut the paper in cooperation with the movable cutting edge, and a fixed-cutting edge dismount position, at which it is not possible to cut the paper in cooperation with the movable cutting edge. Further, when the fixed cutting edge is at the fixed-cutting edge mount position, the movable cutting edge can move between a movable-cutting edge cut position, at which movement of the fixed cutting edge toward the fixed-cutting edge dismount position is not permitted, and a movable-cutting edge non-cut position, at which movement of the fixed cutting edge toward the fixed-cutting edge dismount position is permitted.

In a state in which the fixed cutting edge is at the fixed-cutting edge mount position and the movable cutting edge is at the movable-cutting edge cut position, at least a part of the movable cutting edge is always superimposed with the surface of the fixed cutting edge downstream of the direction of feeding the paper within the cut moving range.

The portion of the movable cutting edge that is always superimposed with the surface of the fixed cutting edge at the downstream of the direction of feeding the paper within the cut moving range, forms a guide section for guiding the front end of the movable cutting edge to the fixed cutting edge, by being in contact with the surface of the fixed cutting edge downstream of the paper-feeding direction.

The guide section is provided at both sides of the movable cutting edge.

The movable cutting edge moves perpendicular to a printing surface of the paper disposed between the movable cutting edge and the fixed cutting edge, and has a V-shape with the center recessed from both ends in the paper width direction.

The printer further comprises a main chassis, and a cutter unit structured separately therefrom, the cutter unit being provided with the movable cutting edge, and a driving mechanism for moving the movable cutting edge at least within the cut moving range.

The cutter unit can move freely between a unit cut position and a unit non-cut position, and the movable cutting edge is at the movable-cutting edge cut position when the cutter unit has moved to the unit cut position, and is at the movable-cutting edge non-cut position when the cutter unit has moved to the unit non-cut position.

The cutter unit is supported by the main frame so as to be able to move between the unit cut position and the unit non-cut position around a swing supporting point.

The printer further comprises a cover frame that is able to swing around a swing supporting point in the main frame, and the cover frame can swing freely between a cover-frame mount position having the fixed cutting edge at the fixed-cutting edge mount position and a cover-frame dismount position having the fixed cutting edge at the fixed-cutting edge dismount position.

The cover frame rotatably supports a platen that conveys the paper, and the main frame supports a line thermal head.

Further, there is provided a printer comprising: a fixed cutting edge; and a movable cutting edge that moves toward the fixed cutting edge over a predetermined cut moving range from a cut starting position to a cut ending position, thereby to cut paper in cooperation with the fixed cutting edge. In this printer, the fixed cutting edge can move between a fixed-cutting edge mount position at which it is possible to cut the paper in cooperation with the movable cutting edge and a fixed-cutting edge dismount position at which it is not possible to cut the paper in cooperation with the movable cutting edge, by crossing the predetermined cut moving range of the movable cutting edge. Further, when the fixed cutting edge moves from the fixed-cutting edge mount position to the fixed-cutting edge dismount position, the movable cutting edge can be moved from a movable-cutting edge cut position that is within the predetermined cut moving range to a movable-cutting edge non-cut position that is not within the predetermined cut moving range.

The printer further comprises a cover frame that is able to swing around a swing supporting point in the main frame, and the cover frame can swing freely between a cover-frame mount position having the fixed cutting edge at the fixed-cutting edge mount position and a cover-frame dismount position having the fixed cutting edge at the fixed-cutting edge dismount position.

The cover frame rotatably supports a platen that conveys the paper, and the main frame supports a line thermal head.

The printer further comprises a main chassis, and a cutter unit separate from the main chassis, and this cutter unit is provided with the movable cutting edge, and a driving mechanism for moving the movable cutting edge at least within the cut moving range. The cutter unit can swing freely between a unit cut position having the movable cutting edge at the movable-cutting edge cut position and a unit non-cut position having the movable cutting edge at the movable-cutting edge non-cut position, toward the main chassis around the swing supporting point.

In a state in which the fixed cutting edge is at the fixed-cutting edge mount position and the movable cutting edge is at the movable-cutting edge cut position, at least a part of the movable cutting edge is always superimposed with the surface of the fixed cutting edge downstream of the direction of feeding the paper within the cut moving range.

The portion of the movable cutting edge that is always superimposed with the surface of the fixed cutting edge downstream of the direction of feeding the paper within the cut moving range, forms a guide section for guiding the front end of the movable cutting edge to the fixed cutting edge, by being in contact with the surface of the fixed cutting edge downstream of the direction of feeding the paper.

The guide section is provided at both sides of the movable cutting edge.

The movable cutting edge moves perpendicular to a printing surface of the paper disposed between the movable cutting edge and the fixed cutting edge, and has a V-shape with the center recessed from both ends in the paper width direction.

Further, there is provided a printer comprising: a main frame equipped with a cutter unit having a movable cutting edge; and a cover frame equipped with a fixed cutting edge for cutting paper in cooperation with the movable cutting edge. The movable cutting edge has a V-shaped cutting edge, with the center recessed in the width direction of the paper, and moves, by way of a driving mechanism provided on the cutter unit, in a direction perpendicular to a printing surface of the paper disposed between the fixed cutting edge and the movable cutting edge, from a cut starting position at which a space through which the paper passes is formed between the fixed cutting edge and the movable cutting edge, to a cut ending position for ending the cutting of the paper. The cutter unit is supported to the main frame so as to be able to move between a unit mount position and a unit dismount position around a swing supporting point. The cover frame rotatably supports a platen that conveys the paper, and is supported to the main frame so as to be able to move freely between the mount position and the dismount position around a swing supporting point. The swing supporting point of the cutter unit and the swing supporting point of the cover frame are provided on mutually parallel axial lines. When the cutter unit is at the cut position, movement of the cover frame from the mount position to the dismount position is restricted, and when the cutter unit is at the non-cut position, movement of the cover frame from the mount position to the dismount position is permitted. When the cutter unit moves from the mount position to the dismount position, the cutter unit is moved to the non-cut position.

The cover unit and the cutter unit have a first engaging section and a second engaging section, respectively. When the cover frame is moved from the dismount position to the mount position, the first engaging section is engaged with the second engaging section, thereby to move the cutter unit to the cut position.

What is claimed is:

1. A printer comprising a main frame equipped with a cutter unit having a movable cutting edge and a cover frame equipped with a fixed cutting edge for cutting paper in cooperation with the moveable cutting edge, wherein the fixed cutting edge of the cover frame can move between a fixed-cutting edge mount position at which it is possible to cut the paper in cooperation with the movable cutting edge of the cutter unit and a fixed-cutting edge dismount position at which it is not possible to cut the paper in cooperation with the movable cutting edge, and when the fixed cutting edge of the cover fame is at the fixed-cutting edge mount position, the movable cutting edge of the cutter unit can move between a movable-cutting edge cut position at which movement of the fixed cutting edge toward the fixed-cutting edge dismount position is not permitted and a movable-cutting edge non-cut position at which movement of the fixed cutting edge toward the fixed-cutting edge dismount position is permitted and wherein the cutter unit is supported by the main frame so as to be able to move between a unit cut position and a unit non-cut position, the cover fame and the cutter unit have a first engaging section and a second engaging section, respectively, and when the fixed cutting edge of the cover frame is moved from the fixed-cutting edge dismount position to the fixed-cutting edge mount position, the first engaging section of the cover frame engages with the second engaging section of the cutter unit to thereby move the cutter unit from the unit non-cut position to the unit cut position.

2. The printer according to claim 1, wherein when the fixed cutting edge is at the fixed-cutting edge mount position and the movable cutting edge is at the movable-cutting edge cut position, at least a part of the movable cutting edge is always superimposed with the surface of the fixed cutting edge downstream of the direction of feeding the paper.

3. The printer according to claim 2, wherein the portion of the movable cutting edge that is always superimposed with the surface of the fixed cutting edge downstream of the direction of feeding the paper, forms a guide section for guiding the front end of the movable cutting edge to the fixed cutting edge, by having contact with the surface of the fixed cutting edge downstream of the direction of feeding the paper.

4. The printer according to claim 3, wherein the guide section is provided at both sides of the movable cutting edge.

5. The printer according to claim 2, wherein the movable cutting edge moves perpendicular to a printing surface of the paper disposed between the movable cutting edge and the fixed cutting edge, and has a V-shape with the center recessed from both ends in the paper width direction.

6. The printer according to claim 1, wherein the cutter unit is provided with a driving mechanism for moving the movable cutting edge.

7. The printer according to claim 6, wherein the cutter unit is supported by the main frame so as to be able to move between the unit cut position and the unit non-cut position around a swing supporting point.

8. The printer according to claim 1, wherein the cover frame can swing freely between a cover-frame mount position having the fixed cutting edge at the fixed-cutting edge mount position and a cover-frame dismount position having the fixed cutting edge at the fixed-cutting edge dismount position.

9. The printer according to claim 8, wherein the cover frame rotatably supports a platen that conveys the paper, and the main frame supports a line thermal head.

10. A printer comprising: a main frame equipped with a cutter unit having a movable cutting edge; and a cover frame equipped with a fixed cutting edge for cutting paper in cooperation with the movable cutting edge, wherein the movable cutting edge has a V-shaped cutting edge, with the center recessed in the width direction of the paper, and moves, with a driving mechanism provided on the cutter unit, in a direction perpendicular to a printing surface of the paper disposed between the fixed cutting edge and the movable cutting edge, from a cut starting position where a space through which the paper can pass is formed between the fixed cutting edge and the movable cutting edge, to a cut ending position for ending the cutting of the paper, the cutter unit is supported by the main frame so as to be able to move between a unit cut position and a unit non-cut position around a swing supporting point, the cover frame rotatably supports a platen that conveys the paper, and is supported to the main frame so as to be able to move freely between a mount position and a dismount position around a swing supporting point, the swing supporting point of the cutter unit and the swing supporting point of the cover frame are provided on mutually parallel axial lines, when the cutter unit is at the unit cut position, movement of the cover frame from the mount position to the dismount position is restricted, and when the cutter unit is at the unit non-cut position, movement of the cover frame from the mount position to the dismount position is permitted, and when the cover frame moves from the mount position to the dismount position, the cutter unit is moved to the unit non-cut position.

11. The printer according to claim 10, wherein the cover frame and the cutter unit have a first engaging section and a second engaging section, respectively, and when the cover frame is moved from the dismount position to the mount position, the first engaging section engages with the second engaging section to thereby move the cutter unit from the unit non-cut position to the unit cut position.

* * * * *